US005221816A

United States Patent [19]

Williams

[11] Patent Number: 5,221,816

[45] Date of Patent: Jun. 22, 1993

[54] PLUNGER SWITCH

[75] Inventor: Thomas D. Williams, Mentor, Ohio

[73] Assignee: Delta Systems, Inc., Streetsboro, Ohio

[21] Appl. No.: 757,050

[22] Filed: Sep. 9, 1991

[51] Int. Cl.[5] ..... H01H 15/06; H01H 13/12

[52] U.S. Cl. ..... 200/16 B; 200/16 D; 200/531

[58] Field of Search ..... 200/11 A, 11 G, 16 B, 200/16 D, 520, 531, 314, 341, 345

[56] References Cited

U.S. PATENT DOCUMENTS

| | | | |
|---|---|---|---|
| 1,763,649 | 6/1930 | Goetz | 200/508 |
| 2,065,904 | 12/1936 | Meuer | 200/530 |
| 3,104,300 | 9/1963 | Hutt | 200/530 |
| 3,419,696 | 12/1968 | Bailey et al. | 200/531 |
| 3,437,775 | 4/1969 | Piber | 200/314 |
| 3,567,874 | 3/1971 | Strobel | 200/16 D |
| 3,663,780 | 5/1972 | Golbeck | 200/314 |
| 3,696,222 | 10/1972 | Langan et al. | 200/16 R |
| 3,767,878 | 10/1973 | Sykora | 200/276.1 |
| 3,818,169 | 6/1974 | Kobernus | 200/531 |
| 3,860,775 | 1/1975 | Koepke | 200/531 |
| 3,946,181 | 3/1976 | Takamizawa et al. | 200/531 |
| 4,096,368 | 6/1978 | Grebner | 200/16 B X |
| 4,137,440 | 1/1979 | Bryant | 200/260 |
| 4,812,604 | 3/1989 | Howard | 200/260 |
| 5,063,277 | 11/1991 | Takano et al. | 200/531 |

*Primary Examiner*—J. R. Scott

*Attorney, Agent, or Firm*—Watts, Hoffmann, Fisher & Heinke

[57] ABSTRACT

A switch comprises a plunger, a retainer, a pair of terminals and an electrically-conducting wiper contact having a curved or bent middle portion defining two oppositely directed legs on either side of the middle portion. The retainer cooperates with the plunger to carry the wiper contact as the plunger moves between a normal and an actuated position. The terminals have facing contact surfaces for biased engagement with the portions of the legs exposed by the plunger and retainer to form an electrical path between the terminals when the plunger is in the actuated position. The plunger and the retainer are coupled together by arms which project from either the plunger or the retainer. The wiper contact is secured between the plunger and retainer without the need for forming a central loop in the wiper contact for engagement by the plunger.

10 Claims, 4 Drawing Sheets

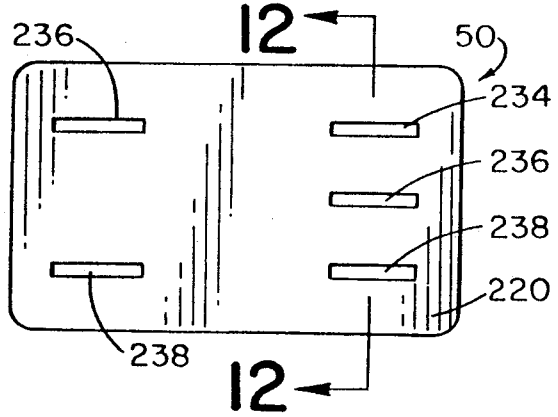
FIG. 11
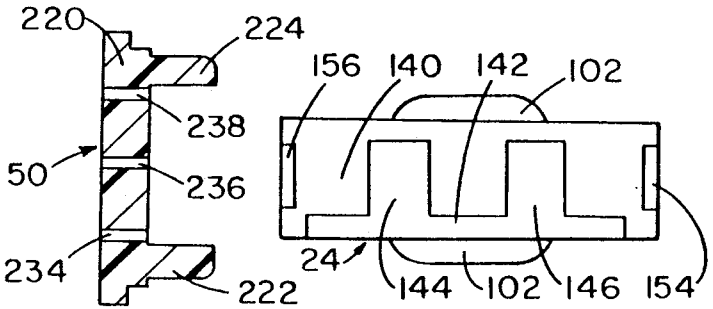
FIG. 12
FIG. 7
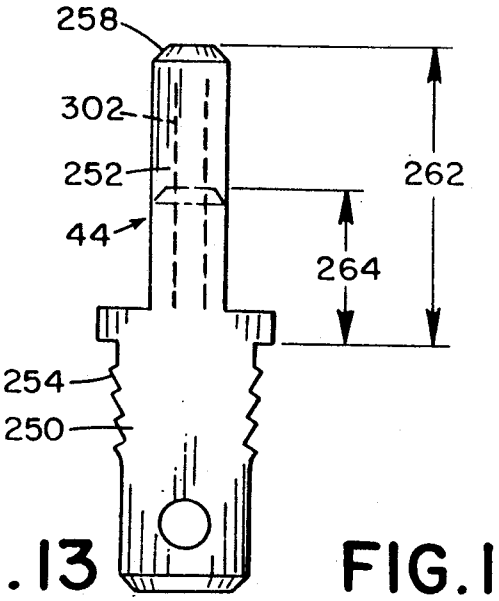
FIG. 13
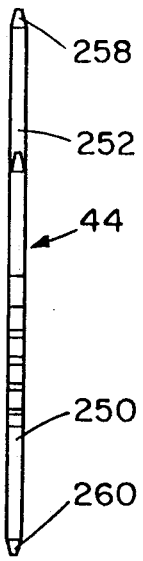
FIG. 14
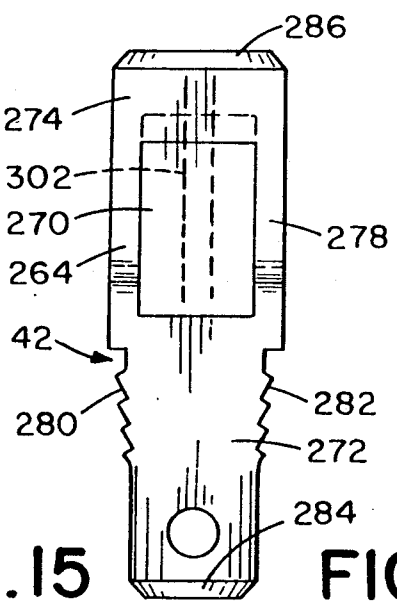
FIG. 15
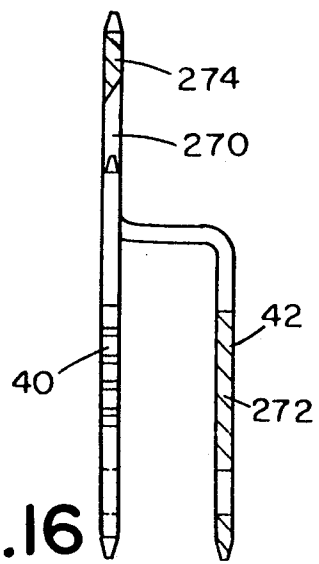
FIG. 16

PLUNGER SWITCH

FIELD OF THE INVENTION

The invention relates to electrical switches, and more particularly to a switch assembly including a wiper contact which is carried by a plunger and selectively bridges a gap between spaced terminals depending on the position of the plunger.

BACKGROUND OF THE INVENTION

Electrical switches using push button or plunger type switch actuators have many applications including use in automobile car doors, ignition circuits, power take-offs for lawn mowers and the like, refrigerator doors, home appliances and the like. These push buttons may be normally open, normally closed or a combination of the two.

It is possible to construct switches having more than two terminals which combine the features of normally open and normally closed switches. For example, a "double-pole double-throw" switch behaves as a normally open switch and a normally closed switch in parallel operated by a single plunger. When the plunger is in a normal position, a pair of normally closed terminals is bridged and a pair of normally open terminals is isolated. Alternatively, when the plunger is moved to an actuated position, the normally open terminals are bridged and the normally closed terminals are isolated. A "single-pole double-throw" switch behaves like a double-pole double-throw switch in which one of the normally open terminals is coupled to one of the normally closed terminals. When the plunger is in the normal position, a common terminal is bridged with a normally closed terminal while a normally open terminal is isolated. Alternatively, when the plunger is in the actuated position, the common terminal is bridged with the normally open terminal while the normally closed terminal is isolated.

Several proposals have been made with respect to switches in which torsion springs, leaf springs or "V"-springs are carried by plungers and used to bridge gaps between spaced terminals when the plungers are appropriately positioned. Such springs must be secured to the plungers so that the springs do not pull loose as the plungers move them into or away from engagement with the terminals. One such proposal uses a wire torsion spring having a central coil mounted on a post projecting from a surface of the plunger. An advantage of this mounting technique is that the spring may be coupled to the plunger without resort to grease to hold the parts together during assembly prior to welding. A drawback to this technique is that forming the loop which engages the post increases the cost of the spring.

SUMMARY OF THE INVENTION

This drawback may be overcome by means of a switch comprising a plunger, a retainer, a pair of terminals and an electrically-conducting wiper contact having a curved or bent middle portion supporting two oppositely biased legs on either side of the curved portion. While the curved portion may include a full loop, it preferably uses a simpler leaf spring or wire "V"-spring. The retainer cooperates with the plunger to carry the wiper contact as the plunger moves between normal and actuated positions. The terminals have facing contact surfaces for biased engagement with portions of the legs of the wiper contact exposed by the plunger and retainer to form an electrical path between the terminals when the plunger is in the either the normal or the actuated position.

The plunger and the retainer are coupled together by projections extending from either the plunger or the retainer toward the other. One example of such coupling includes two projections from either side of the plunger having stops at their ends. The projections are received in slots in the sides of the retainer in such manner that the sides of the retainer are secured between the plunger and the stops. The plunger and retainer together are capable of carrying a leaf spring or wire "V"-spring not having a loop for engagement with a post.

From the foregoing, one object of the invention is to simplify the construction of plunger switches and to reduce the cost of their manufacture. This and other objects and advantages, and a full understanding of the invention, will become apparent to those skilled in the art from the following description of the best mode and accompanying drawings.

BRIEF DESCRIPTION OF THE DRAWINGS

FIGS. 5, 6 and 7 are elevational views of a plunger for use in the switch of FIG. 1;

FIG. 11 is an elevational view of a cover plate for use in the switch shown in FIG. 1;

FIG. 12 is a sectional view taken along the line 11—11 in FIG. 10;

FIGS. 13 and 14 are elevational views of one form of switch terminal for use in the switch of FIG. 1 as a common terminal;

FIG. 15 is elevational view of a normally open switch terminal for use in the switch of FIG. 1; and FIG. 16 is a composite view showing the normally open terminal of FIG. 15, shown in section as seen from the plane deined by the line 16—16 in FIG. 15, nested with a normally closed terminal.

DETAILED DESCRIPTION OF THE PREFERRED EMBODIMENT

Figure 1:
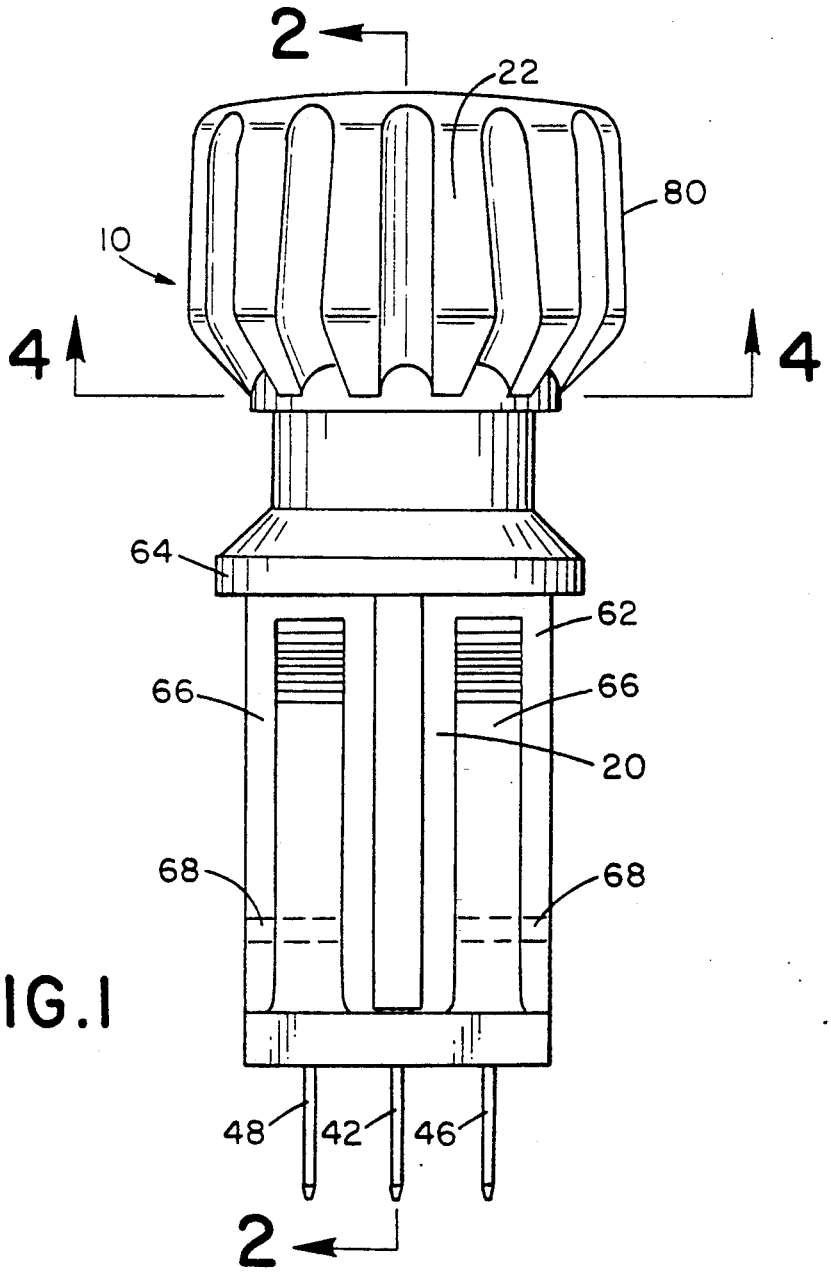
FIG. 1 is an elevational view of a plunger switch embodying the invention.
Figure 3:
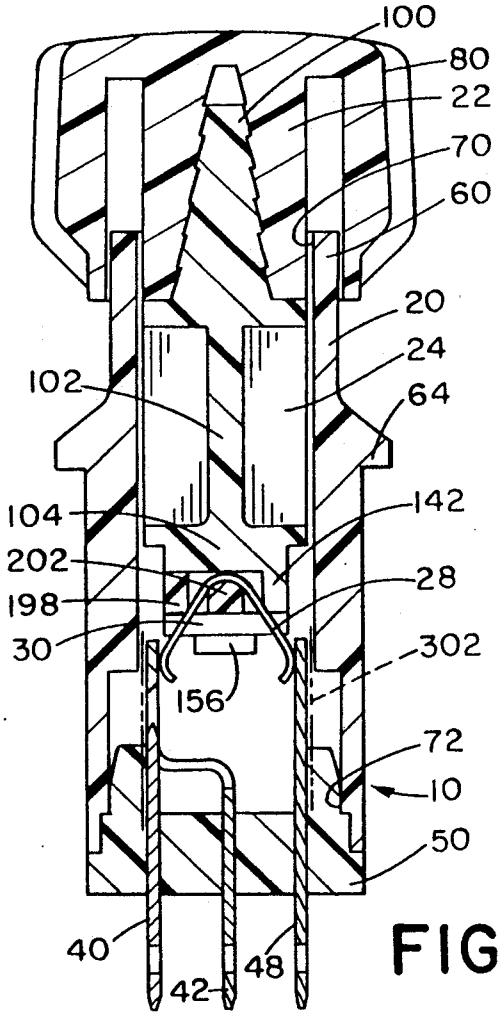
FIG. 3 is a sectional view as seen from the plane defined by the line 3—3 in FIG. 2; with the switch in the normal position
Figure 2:
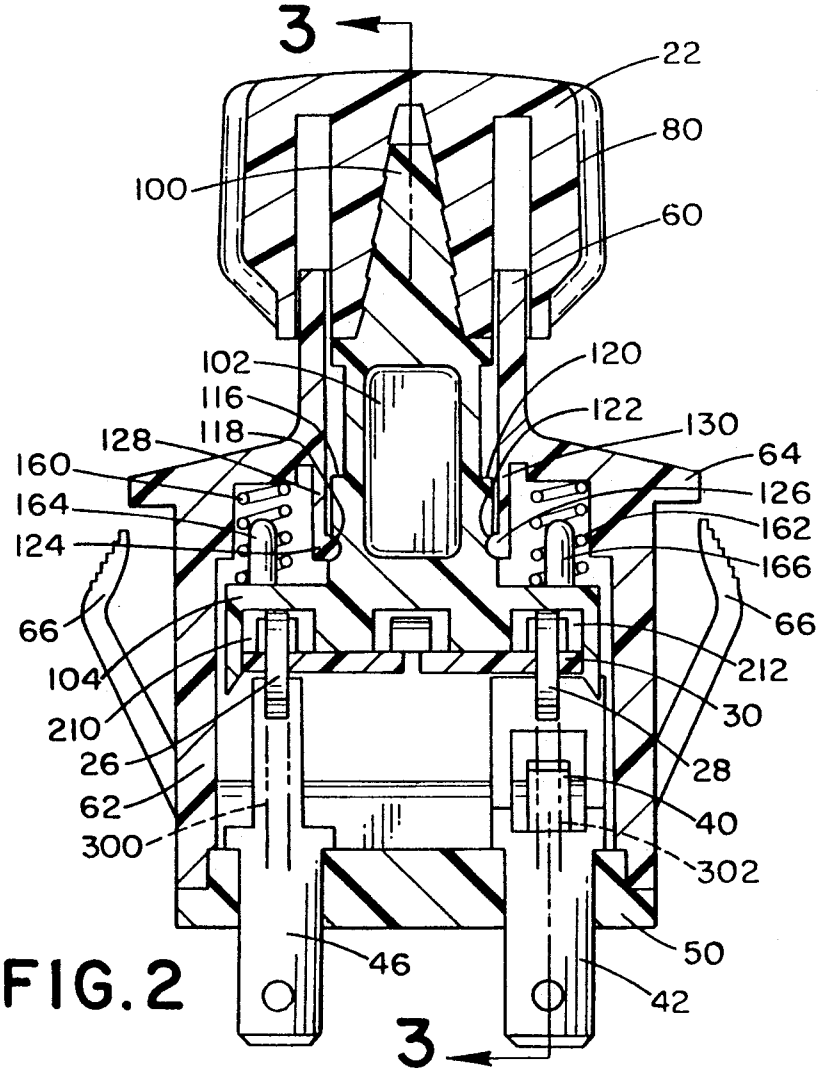
FIG. 2 is a sectional view taken along the line 2—2 in FIG. 1.
Figure 8:
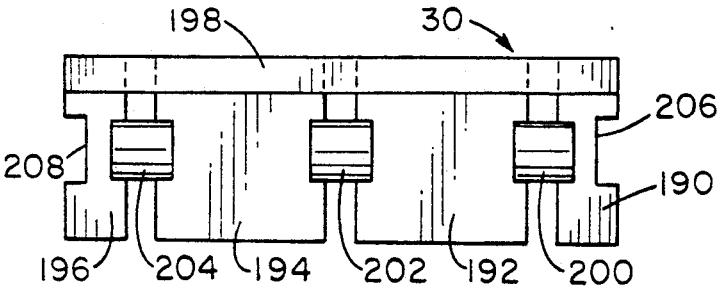
FIGS. 8 and 9 are elevational views of a retainer coupleable to the plunger shown in FIGS. 5, 6 and 7.
Figure 9:
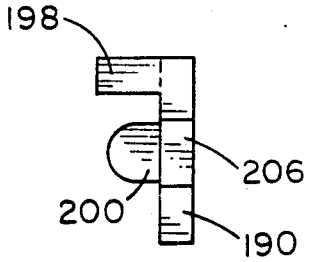

FIGS. 1, 2 and 3 show a plunger switch 10 according to the invention which combines the features of a single-pole, double throw switch and a double-pole, double throw switch. One application of the switch 10 is as a power take-off for a lawn mower, controlling the transfer of power from an engine output shaft to an accessory such as the lawn mower blades. The switch 10 includes a housing 20 which surrounds a plunger 24. The plunger 24 engages a cap 22 which may be gripped to slide the plunger between a normal and an actuated position in the housing 20. The plunger 24 carries a pair of conductive wiper contacts 26, 28 secured to the plunger by means of a retainer 30 (FIGS. 3, 8 and 9).

The switch 10 also includes five switch terminals 40, 42, 44, 46, 48 which extend through a cover plate 50 attached to the housing 20 for communication with an external circuit. In the switch 10, the normal position (not shown) occurs when the plunger 24 is nearest the terminals 40, 42, 44, 46, 48, and the actuated position (FIGS. 1, 2 and 3) occurs when the plunger 24 is farthest from them. These switch terminals include two normally closed terminals 40, 46; a normally open terminal 42 and two common terminals 44, 48 which are coupled to the wiper contacts 26, 28 at all times. The normally closed terminal 40 and normally open terminal 42 are nested so that the terminal 44 and the wiper contact 28 are in electrical engagement with the normally open terminal 40 when the plunger 22 is in a normal position and in electrical engagement with the normally open terminal 42 when the plunger is in an actuated position.

The switch 10 is enclosed and supported by a housing 20. The housing 20 is an integral plastic molding comprising a neck portion 60 opening into an approximately prismatic body portion 62. Both the body portion 62 and the neck portion 60 are hollow, and the housing 20 has openings 70, 72 (FIG. 3) at its opposite ends leading into the interior of the housing 20. The housing 20 includes a flange 64 near the junction between the neck portion 60 and the body portion 62. The flange 64 cooperates with four clips 66 which are hinged to the sides of the body portion 62 to secure the switch 10 in a panel or other frame which engages between the flange 64 and the clips 66. A hinge 68 (FIG. 1) is cut at the base of each of the clips 66 to facilitate bending of the clips 66 as the switch is pushed through an opening in the panel or frame.

Figure 4:
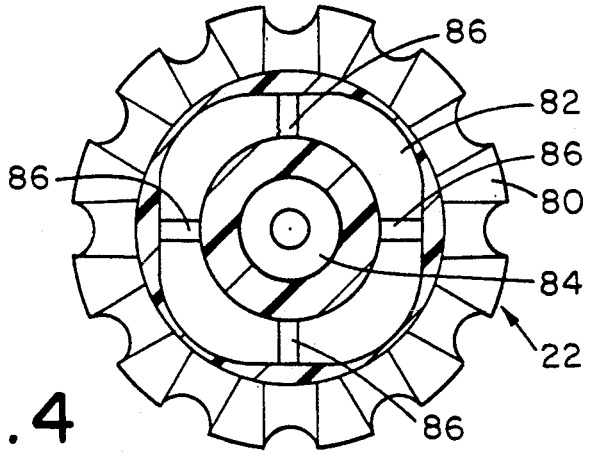
FIG. 4 is a sectional view of a switch cap for use in the switch shown in FIG. 1, taken along the section line 4—4 in FIG. 1.

The cap 22 has a ribbed exterior surface 80 to permit an operator to grip the cap 22 and slide it along the neck portion 60 of the housing 20 in order to actuate the switch 10. Within the ribbed exterior 80, the switch 10 includes two concentric openings, an annular passage 82 for receiving the neck portion 60 of the housing 20 and an inwardly tapering central hole 84 for engagement with the plunger 24. As best shown in FIG. 4, the annular passage 82 has a non-circular profile approximating a square with rounded corners which cooperates with a similar outer profile of the neck portion 60 to resist rotation of the plunger 24 in the housing 20 as the cap 22 is moved. At the base of the annular passage 82 are a plurality of ribs 86 for strengthening the cap 22.

Figure 5:
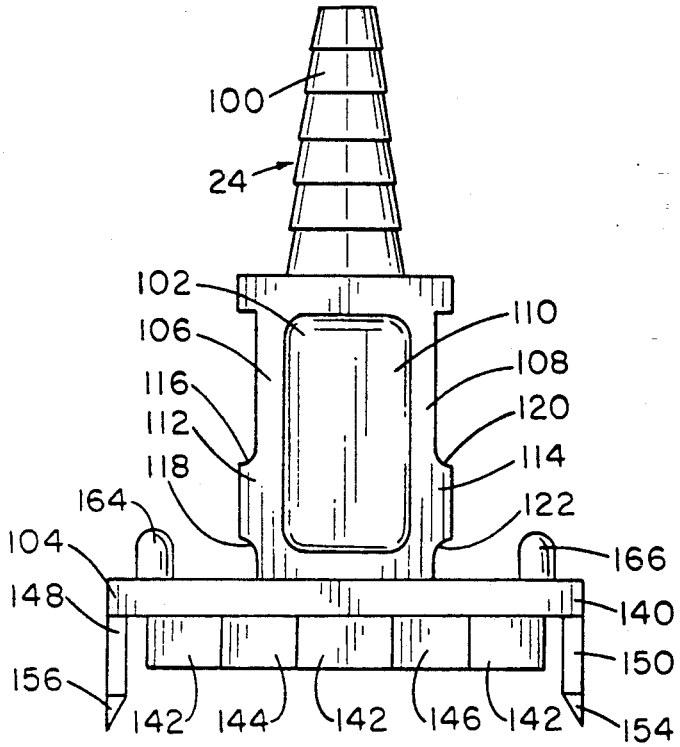
Figure 6:
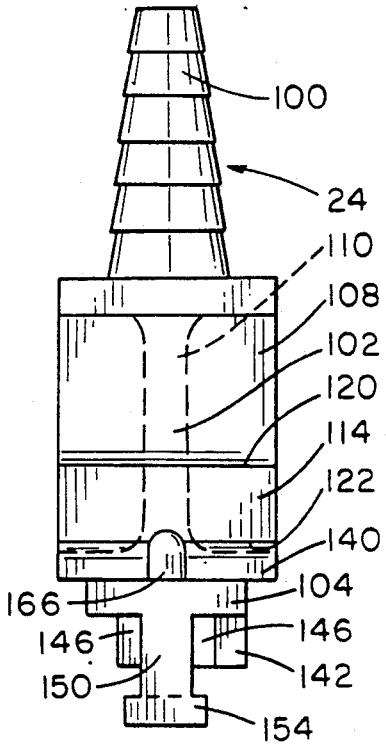

The cap 22 engages the plunger 24 so that the plunger 24 may be slid along a path of travel between the normal position and the actuated position. The plunger 24 (FIGS. 5, 6 and 7) includes a frusto-conical portion 100, a body portion 102 and a base portion 104 which carries the wiper contacts 26, 28. The frusto-conical portion 100 is dimensioned to make a close fit with the inner surface of the tapered hole 84 in the cap 22 and has a serrated surface to enhance the frictional engagement of the frusto-conical portion 100 in the hole 84. (Alternatively, the portion of the plunger 24 engaging the cap 22 may be keyed to restrict the rotation of the plunger 24 relative to the cap 22.)

The body portion 102 of the plunger 24 cooperates with the housing 20 to fix the normal and actuated positions of the plunger 24. In order to minimize the bulk of the plunger 24, the body portion 102 is formed from a pair of side walls 106, 108 connected by a web 110. The side walls 106, 108 each mount a rib 112, 114 which define two pairs of parallel slots 116, 118, 120, 122. As best shown in FIG. 2, these slots 116, 118, 120, 122 cooperate with detents 124, 126 raised from the surface of resilient projections 128, 130 from the inner surface of the housing 20 to define the normal and actuated positions of the plunger, the normal position being defined by slots 116 and 120 and the actuated position being defined by slots 118 and 122.

The base portion 104 of the plunger 24 cooperates with the retainer 30 to carry the wiper contacts 26, 28. The base portion 104 includes a pedestal 140 from which an apron 142, a pair of dividers 144, 146 and a pair of projections 148, 150 extend. At the end of each projection 148, 150 is a stop 154, 156 having greater transverse width than the projections 148, 150.

Compression springs 160, 162 engage the housing 20 and plunger 24 to bias the plunger 24 away from the actuated position toward the normal position. The springs 160, 162 are positioned on posts 164, 166 extending from the pedestal 140 of the plunger 24 and press against the pedestal 140. Preferably, the normal forces exerted on the detents 124, 126 by the projection 128, 130 is sufficient to maintain the detents 124, 126 in engagement with the slots 118, 122 when the plunger 24 is in the actuated position despite the bias of the springs 160, 162 so that the plunger 24 remains stably in the actuated position without the operator having to continue to pull the cap 22 away from the housing 20.

Figure 10:
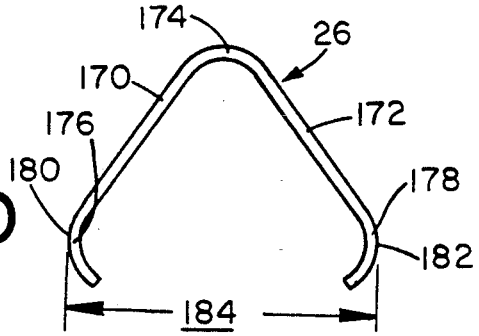
FIG. 10 is an elevational view of a wiper contact for use in the switch shown in FIG. 1.

The wiper contacts 26, 28 travel with the plunger between the normal and actuated positions. The wiper contacts 26, 28 are of identical construction, with wiper contact 26 (FIG. 10) comprising oppositely directed legs 170, 172 coupled by a curved or bent middle portion 174. Near the exposed end of each leg 170, 172 is a curved portion 176, 178 which exposes a tangential surface 180, 182 for contact with the terminals 40, 42, 44, 46, 48. The legs 170, 172 are preferably resilient so that a biasing force is created when the legs 170, 172 are compressed toward each other from an undeformed span (shown schematically as 184 in FIG. 10). In order to simplify the manufacture of the switch 10, the wiper contacts 26, 28 are preferably either leaf springs formed from strips of metal having constant widths or wire "V"-springs, though the design of the switch 10 could be adapted for torsion springs having central coils.

The retainer 30 secures the wiper contacts 26, 28 to the plunger 24 so that the wiper contacts 26, 28 move with the plunger 24 between the normal and actuated positions. The retainer 30 (FIGS. 8 and 9) comprises platform portions 190, 192, 194, 196 bound together by a continuous wall portion 198 and by bosses 200, 202, 204. The outer platform portions 190, 196 each includes a slot 206, 208 in their respective outer sides which engage the projections 148, 150 (FIG. 5) to secure the retainer to the base portion 104 of the plunger 24.

When the retainer 30 is secured to the base portion 104 of the plunger 24, they cooperate to define a pair of compartments 210, 212 bounded on top by the pedestal 140; below by the platform portions 190, 192, 194, 196; on one side by the apron 142; on the opposite side by the wall portion 198; and on the remaining side by the dividers 144, 146 and projections 148, 150. The bosses 200, 204 project into these compartments 210, 212 in order to secure the middle portions 174 of the wiper contacts 26, 28.

As best shown in FIG. 3, the rounded bosses 200, 204 engage the undersides of the middle portions 174 and press these middle portions against the pedestal 140. The legs 170, 172 of the wiper contacts 26, 28 project outwardly through the gaps between the platform portions 190, 192, 194, 196 for contact with the terminals 40, 42, 44, 46, 48. (The same plunger 24 and retainer 30 could also carry a third wiper contact parallel to wiper contacts 26, 28 having its middle portion held by the central boss 202 between the two dividers 144, 146.)

The retainer 30 is coupled to the plunger 24 by means of projections 148, 150 from the base portion 140 of the plunger 24 which engage slots 206, 208 in the sides of the retainer 30. The slots 206, 208; the projections 148, 150 and the stops 154, 156 are so dimensioned and so positioned that the projections 148, 150 fit closely into the slots 206, 208 and the sides of the platform portions 190, 196 fit closely between the apron 142 and dividers 144, 146 on one side and the stops 154, 156 on the other side to frictionally and resiliently couple the retainer 30 to the plunger 24. While the frictional and resilient coupling between the plunger 24 and retainer 30 is sufficient in itself to hold the two members in engagement, it is preferred to weld the two elements together in order to strengthen the coupling.

The terminals 40, 42, 44, 46, 48 are positioned adjacent the paths of the wiper contacts 26, 28 by a cover plate 50 which fits over the open bottom section of the housing 20. The cover plate 50 (FIGS. 11 and 12) is an integral plastic molding comprising a plate portion 220 and a pair of guides 222, 224 projecting along opposite ends of one face of the plate portion 220. The distance between the outer surfaces of the guides 222, 224 is slightly smaller than the width of the opening 72 (FIG. 3) at the bottom of the housing 20 so that the guides 222, 224 help to center the plate portion 220 over the opening 72 and properly locate the terminals 40, 42, 44, 46, 48 with respect to the wiper contacts 26, 28. Preferably, the cover plate 50 is welded to the housing 20 to provide a moisture-tight seal over the opening 72.

The cover plate 50 includes five slots 230, 232, 234, 236, 238 through which the terminals 40, 42, 44, 46, 48 communicate with a circuit external to the switch (not shown). The terminals fit through the slots as follows:

| Terminal | Slot |
|---|---|
| 40 | 230 |
| 42 | 232 |
| 44 | 234 |
| 46 | 236 |
| 48 | 238 |

Preferably, the terminals 40, 42, 44, 46, 48 are held in the slots 230, 232, 234, 236, 238 by friction. In an alternative embodiment (not shown), the surface of the cover plate 50 facing away from the housing 20 (shown in FIG. 11) may include integral ridges surrounding the slots 230, 232, 234, 236, 238 in order to increase the surface area of plastic in frictional engagement with the terminals 40, 42, 44, 46, 48 and thereby better secure the terminals 40, 42, 44, 46, 48 in the slots 230, 232, 234, 236, 238.

The terminals 40, 42, 44, 46, 48 are positioned for engagement with the wiper contacts 26, 28, which selectively complete electrical paths between the terminals 40, 42, 44, 46, 48 as the plunger 24 moves between the normal and actuated positions. The common terminals 44 and 48 are identical in construction and are each designed to engage one of the wiper contacts 26, 28 in both the normal and actuated positions. The common terminal 44 (FIGS. 13 and 14) consists of a continuous flat sheet of metal having a circuit-engaging portion 250 for retention in the slot 234 and a wiper-engaging portion 252 for engagement with one of the legs of the wiper contact 26. The circuit-engaging portion 250 is dimensioned to provide a close fit in the slot 234. Serrated sections 254, 256 of the sides of the circuit-engaging portion 250 strengthen the coupling between the terminal 44 and the slot 234 when the circuit-engaging end 250 of the common terminal 44 is pushed through the slot 234 during assembly of the switch 10. The upper and lower ends 258, 260 of the common terminal 44 are beveled, which facilitates pushing the circuit-engaging end 250 through the slot 234. The length 262 of the common terminal 44 is sufficient that the wiper contact 26 remains in continuous engagement with the wiper-engaging portion 252 of the common terminal 44 as the plunger 24 moves between the normal and actuated positions.

The normal closed terminals 40, 46 (not shown separately) consist of identical flat metal sheets similar in shape to the common terminal 44. Like the common terminal 44, the normally closed terminals 40, 46 have circuit-engaging portions for retention in the slots 230, 236 and wiper-engaging portions for engagement with the legs of the wiper contacts 26, 28 opposite those engaging the common terminals 44, 48. The circuit-engaging portions of the normally closed terminals 40, 46 are identical to the circuit-engaging portion 250 of the common terminal 44. On the other hand, the wiper-engaging portions of the terminals 40, 46 are shorter than the wiper-engaging portion 252 of the common terminal 44, so that the normally closed terminals 40, 46 have a shorter overall length as shown at 264 (FIG. 13). The shorter overall length of the normally closed terminals 40, 46 permit the wiper contacts 26, 28 to engage the normally closed terminals 40, 46 when the plunger is in the normal position and to disengage the normally closed terminals 40, 46 when the plunger is in the actuated position. As with the common terminal 44, the upper ends of the normally closed terminals 40, 46 are beveled, which facilitates the initial deflection of the legs of the wiper contacts 26, 28 as the plunger returns from the actuated to the normal position and the wiper contacts 26, 28 move into engagement with the normally closed terminals 40, 46.

The normally open terminal 42 consists of a metal piece having a cut-out portion 270 so that the terminal is isolated from the wiper 28 when the plunger 24 is in the normal position and engaged with the wiper 26 when the plunger 24 is in the actuated position. The normally open terminal 42 includes a circuit-engaging portion 272 for retention in the slot 232 in the cover plate 50, a wiper-engaging portion 274 for engagement with a leg of the wiper contact 28 and a pair of support structures 276, 278 for supporting the wiper-engaging portion 274. As was the case with the common terminal 44, the sides of the circuit-engaging portion of the normally open terminal 42 include serrated sections 280, 282 which strengthen the coupling between the normally open terminal 42 and the slot 232, and a beveled end 284 which facilitates the insertion of the normally open terminal 42 through the slot 232. The end 286 of the normally open terminal 42 is also beveled.

The supporting structures 276, 278 of the normally open terminal 42 are bent twice at right angles so that the wiper-engaging portion 274 of the normally open terminal 42 is aligned with the wiper-engaging portion of the normally closed terminal 40 (FIGS. 2 and 3). Since the cut-out portion 270 of the normally open terminal 42 is wider than the wiper-engaging portion of the normally closed terminal 40 (the latter being of the same width as the wiper-engaging portion 252 of the terminal 44 in FIG. 13), the normally open terminal 42 and normally closed terminal 40 are nested and electrically isolated from one another. As a consequence, the wiper contact 28 engages the normally closed contact 40 when the plunger 24 is in the normal position and the normally open contact 42 when the plunger is in the actuated position.

As the wiper contacts 26, 28 are carried by the plunger along its path between the normal and actuated positions, they trace out a pair of imaginary rectangular corridors 300, 302 (shown in broken lines in FIGS. 2 and 3) each having a span equal to the undeformed span 184 of the wiper contacts 26, 28 and a width equal to the width of one of the wiper contacts 26, 28. Clearly, any structure intersecting these corridors 300, 302 will be engaged by a leg of one of the wiper contacts 26, 28 at some point in the plunger's 24 movement between the normal and actuated positions, while no structure outside of these corridors 300, 302 will directly engage the wiper contacts 26, 28.

As shown schematically in FIGS. 13 and 15, the wiper-engaging portion 252 of common terminal 44 and the wiper-engaging portion 274 of normally open terminal 42 (as well as the wiper-engaging portions of the normally closed terminal 40) intersect the corridor 302 and will be engaged by the wiper 28. (Likewise, the wiper-engaging portions of the normally closed terminal 46 and the common terminal 48 intersect the corridor 300.) Consequently, these wiper-engaging portions will be engaged by the wiper contacts 26, 28 at some point along the path of travel of the plunger 24. On the other hand, the support structures 276, 278 supporting the wiper-engaging portion 274 of normally open terminal 42 are outside the corridor 302, and so do not directly engage the wiper contact 28. Since the circuit-engaging portions (e.g., 250, 272) of the terminals 40, 42, 44, 46, 48 are beyond the reach of the wiper contacts 26, 28 even when the plunger 24 is in the actuated normal position, the circuit-engaging portions likewise do not directly engage the wiper contacts 26, 28.

When the plunger 24 is in the normal position, the wiper contact 26 engages both the terminals 46 and 48, completing an electrical path between these terminals. Likewise, the wiper contact 28 engages both the terminals 40 and 44, completing an electrical path between those terminals. When an operator pulls outwardly on the cap 22, the plunger 24 is moved from the normal to the actuated position against the bias of the springs 160, 162. When the plunger 24 is in the actuated position, the wiper contact 26 engages the common terminal 48 but no longer engages the normally closed terminal 46, so that no electrical path is completed across the wiper contact 26. On the other hand, wiper contact 28 now engages the common terminal 44 and the normally open terminal 42, thereby completing an electrical path across those terminals. Pressing the cap 22 returns the plunger 24 to the normal position and the wiper contacts 26, 28 to the condition described previously. The detents 124, 126 interact with the recesses 116, 118, 120, 122 to stabilize the plunger 24 in the normal or actuated condition in the absence of an external force applied to the cap 22.

One significant advantage of the switch 10 is ease of assembly. As stated previously, the switch 10 uses leaf or wire "V"-springs rather than torsion springs requiring the formation of a central loop as wiper contacts. During assembly, the middle portion 174 (FIG. 10) of the wiper contact 26 is placed over the boss 204 on the surface of the retainer 30 with its legs 170, 172 extending through the gap between the platform portions 194, 196. Similarly, the middle portion of the wiper contact 28 is placed over the boss 200 on the surface of the retainer 30 with its legs extending through the gap between the platform portions 190, 192. The retainer 30 is the pressed against the base portion 140 of the plunger 24 so that the middle portion 170 of the wiper contact 26 is positioned between the divider 146 and the projection 150, and the middle portion of the contact 28 is positioned between the divider 144 and the projection 148. As the retainer 30 is pressed against the base portion 140 of the plunger 24, the projections 148, 150 flex outward and snap into the slots 206 in the platform portion 190, 196 of the retainer 30. No grease or other bonding agent is required to hold the wiper contacts 26, 28; the retainer 30 or the plunger 24 together while the four are being assembled into a unit. Meanwhile, springs 160, 162 are pressed onto the posts 164, 166 on the base portion 140 of the plunger 24.

The plunger 24 is then slid through the opening 72 in the housing 20 until the body portion 102 of the plunger 24 is positioned between the detents 124, 126 and the frusto-conical portion 100 of the plunger 24 extends into the neck portion 60 of the housing 20. As the plunger 24 is slid into the housing 20, the springs 160, 162 engage the inner surface of the housing flange 64. The cap 22 is slid over the neck portion 60 of the housing 20 and pressed onto frusto-conical portion 100 of the plunger 24. The plunger 24 and cap 22 form a unit which is restrained by the interaction between the passage 82 in the cap 22 and the neck portion 60 of the housing 20 to slide along the neck portion 60 without rotation.

Meanwhile, the circuit-engaging portions (e.g., 250, 272) of the terminals 40, 42, 44, 46, 48 are pressed through the slots 230, 232, 234, 236, 238 into frictional engagement with the cover plate 50. The cover plate 50 is positioned over the opening 72 in the housing with the guides 222, 224 extending into the interior of the housing 20 to position the terminals 40, 42, 44, 46, 48 with respect to the wiper contacts 26, 28. The cover plate 50 is welded to the housing 20 in order to form a moisture-tight seal for the components of the switch 10.

Many modifications and variations of the invention will be apparent to those skilled in the art in light of the foregoing detailed disclosure. Therefore, it is to be understood that, within the scope of the appended claims, the invention can be practiced otherwise than as specifically shown and described.

I claim:

1. Switch apparatus comprising:

a) a switch housing defining a housing interior having an access opening that extends through a wall of said housing to the housing interior;

b) an actuator assembly including:

i) a plunger constrained by said housing to translate along a path including a normal position and an actuated position and having a plunger body portion which extends through the access opening;

ii) one or more conductive wiper contacts having a middle portion supporting two outwardly extending legs;

iii) a retainer cooperating with the plunger to engage the middle portion of the one or more conductive wiper contacts and couple the contacts to the plunger as the actuator assembly is inserted into the housing interior; and c) a plurality of terminals having conductive surfaces for biased engagement with outer surface portions of the legs of said one or more wiper contacts to form an electrical path between terminals when the plunger is in either the normal or the actuated position; and d) said actuator assembly including at least two projections each extending away from one of the plunger and retainer for engagement with the other of the plunger and retainer to frictionally and resiliently couple the plunger and retainer together to connect the one or more wiper contacts to the plunger.

2. A switch according to claim 1 wherein the projections are integral with the plunger and each includes a stop spaced from the plunger; and wherein the retainer includes slots at either side for receiving the projections in such a manner that the sides of the retainer are secured between the plunger and the stops.

3. A switch according to claim 1 including a housing having a neck portion for restraining the plunger to slide along an axis of the neck portion, and at least one spring engaging the housing and the plunger to bias the plunger into or out of the actuated position.

4. A switch according to claim 1 including a housing at least partially surrounding the plunger, the housing including detents for engaging slots on the plunger to define the normal and actuated positions of the plunger.

5. A switch according to claim 1 wherein the wiper contact is a leaf spring.

6. A switch comprising:

a) a plunger constrained to translate along a path including a normal position and an actuated position;

b) plunger biasing means for biasing the plunger away from the actuated position and toward the normal position;

c) a conductive wiper contact carried by the plunger including a pair of resilient legs defining an electrically bridgeable corridor along the path of travel of the plunger having a span equal to an undeformed span of the pair of legs and a width equal to the maximum width of the wiper contact;

d) a normally open terminal having an electrically conductive portion within the bridgeable corridor of the wiper contact positioned to be contacted by the wiper contact when the plunger is in the actuated position; and e) a normally closed terminal having an electrically conductive portion within the bridgeable corridor of the wiper contact and positioned to be contacted by the wiper contact when the plunger is in the normal position;

f) wherein the normally open and normally closed terminals are supported by structure outside the bridgeable corridor of the wiper contact so that the normally open and normally closed terminals are isolated from each other when the plunger is in the normal position and the actuated position and wherein one of the normally open and normally closed terminals comprises an electrically conductive sheet having a width greater than the bridgeable corridor of the wiper contact and a cut-out portion to isolate the contact from a contact surface of the other of the normally open or normally closed terminal which is generally co-planar with the cut-out portion of the conductive sheet.

7. A switch according to claim 6 wherein at least one of the normally open or normally closed contacts is in electrical engagement with one of the wiper contacts both when the plunger is in the normal position and when the plunger is in the actuated position.

8. A switch according to claim 6 including a housing at least partially surrounding the plunger and constraining the plunger for translation along said path, the housing including detents for engaging slots on the plunger to define the normal and actuated positions of the plunger.

9. A switch according to claim 6 wherein at least one of the wiper contacts is a leaf spring.

10. A switch comprising:

a) a housing having an opening at one end;

b) a plunger engageable through the opening and restrained for linear motion in the housing between a normal position and an actuated position, the plunger having a base portion defining two spaced compartments;

c) first and second conductive leaf springs, each including a middle portion positioned in one of the compartments defined by the base portion of the plunger which middle portion supports two oppositely directed legs with curved portions defining oppositely facing tangential surfaces;

d) a retainer secured to the plunger by means of projections integral with, and extending from, one of the plunger and retainer for frictional and resilient engagement with the other, the retainer including structure extending into the compartments defined by the base portion and engaging the middle portions of the leaf springs to restrain the leaf springs to move with the plunger; and e) two pairs of terminals with facing surfaces, each pair of terminals constructed and arranged for engagement between its respective facing surfaces and the tangential surfaces of one of the first and second leaf springs.

* * * * *